US006882976B1

(12) United States Patent
Hsu et al.

(10) Patent No.: US 6,882,976 B1
(45) Date of Patent: Apr. 19, 2005

(54) EFFICIENT FINITE LENGTH POW10 CALCULATION FOR MPEG AUDIO ENCODING

(75) Inventors: Wei-Lien Hsu, Austin, TX (US); Travis Wheatley, Austin, TX (US)

(73) Assignee: Advanced Micro Devices, Inc., Sunnyvale, CA (US)

( * ) Notice: Subject to any disclaimer, the term of this patent is extended or adjusted under 35 U.S.C. 154(b) by 651 days.

(21) Appl. No.: 09/797,041

(22) Filed: Feb. 28, 2001

(51) Int. Cl.[7] ..... G10L 19/00

(52) U.S. Cl. ..... 704/500; 704/268; 704/501; 704/503; 381/104; 381/107

(58) Field of Search ..... 704/500–504, 704/268, 200.1, 214, 229, 230; 381/104, 107; 341/50, 87; 84/604, 601, 603, 602, 609

(56) References Cited

U.S. PATENT DOCUMENTS 5,252,773 A * 10/1993 Kozuki et al. ..... 84/607
5,721,806 A 2/1998 Lee
5,764,698 A 6/1998 Sudharsanan et al.
5,805,770 A * 9/1998 Tsutsui ..... 701/224
5,864,802 A * 1/1999 Kim et al. ..... 704/230
6,137,046 A * 10/2000 Kamiya ..... 84/604
6,385,572 B1 * 5/2002 Hu ..... 704/200.1

OTHER PUBLICATIONS

"A Tutorial on MPEG/Audio Compression", Pan, *IEEE Multimedia Journal*, Summer 1995.

* cited by examiner

*Primary Examiner*—Susan McFadden
*Assistant Examiner*—Huyen X. Vo
(74) *Attorney, Agent, or Firm*—Meyertons Hood Kivlin Kowert & Goetzel, P.C.; B. Noël Kivlin

(57) ABSTRACT

An efficient finite length POW10 calculation for MPEG audio encoding. A method for encoding an audio input signal includes storing a plurality of predetermined tonal values corresponding to a plurality of predetermined power levels. The method also includes receiving a plurality of input values each representative of a power level of a spectral component of the audio input signal at a corresponding frequency sub-band and accessing at least one corresponding tonal value of the plurality of predetermined tonal values. The method further includes generating an encoded output signal representative of the audio input signal by using at least one corresponding tonal value for each of the plurality of input values. Further, the storing of the plurality of predetermined tonal values is performed prior to the receiving of the plurality of input values.

18 Claims, 3 Drawing Sheets

| Tonal Value Integer Table 300 | |
|---|---|
| int_part[ ] | int_pow[ ] |
| 0 | 1.000000 |
| 1 | 10.000000 |
| 2 | 100.000000 |
| 3 | 1000.000000 |
| 4 | 10000.000000 |
| ⋮ | ⋮ |
| 38 | 100000000000000000000000000000000000000.000000 |
| 39 | 1000000000000000000000000000000000000000.000000 |
| 40 | 10000000000000000000000000000000000000000.000000 |
| ⋮ | ⋮ |
| 511 | 1000000000000000000000000000000000000000000.000000 |

FIG. 3A

| Tonal Value Decimal Table 350 | |
|---|---|
| dec_part[ ] | dec_pow[ ] |
| 0 | 1.000000 |
| 1 | 1.002251 |
| 2 | 1.004507 |
| 3 | 1.006769 |
| 4 | 1.009035 |
| 5 | 1.011307 |
| 6 | 1.013583 |
| ⋮ | ⋮ |
| 1023 | 9.977538 |

FIG. 3B

EFFICIENT FINITE LENGTH POW10 CALCULATION FOR MPEG AUDIO ENCODING

BACKGROUND OF THE INVENTION

1. Field of the Invention

This invention relates to digital audio compression and, more particularly, to MPEG audio encoding.

2. Description of the Related Art

The computational capability of modern computer systems and the use of compression algorithms have made the use of complex multimedia applications possible. For example, a personal computer or workstation may be capable of running applications that allow a user to listen to high quality music reproductions or watch a motion picture. Compression algorithms may allow a digital signal to be transferred at a very high bit rate.

There are many compression algorithms available for compressing digital audio signals such as Code Excited Linear Prediction (CELP), $\mu$-law and Adaptive Differential Pulse Code Modulation (ADPCM). Compressing an audio signal allows a higher bit density to be transmitted from an encoding device to a decoding device and it allows a higher bit density when storing an audio sample to a storage medium such as a compact disk (CD).

Another compression algorithm, known as the (MPEG)/audio compression algorithm, was developed by the Moving Picture Experts Group as an international standard for compressing high-fidelity audio. The MPEG/audio standard is one part of a three-part standard relating to the compression of audio and video and the synchronization of the respective audio and video streams. For a more detailed description of the MPEG/audio compression algorithm, see the ISO/IEC 11 172-3 standard.

The MPEG/audio compression standard is based on the perceptual limitations of the human auditory system. Thus, the portions of an audio signal that may be either out of the normal auditory range or masked by stronger portions are removed from the signal. Although the removal of these components results in a distorted signal, the distortions may either be inaudible or barely perceptible.

In an MPEG encoder, incoming digital audio samples are separated into frequency bands and encoded. This may be accomplished using a polyphase filter bank and a psychoacoustic model. The filter bank may utilize one form of a discrete cosine transform. The psychoacoustic model may use a Fourier transform for frequency domain transformation. In the psychoacoustic model, the frequency spectra are then separated into sub-bands and calculations are performed to determine the signal-to-mask ratios used in final quantization and encoding of the digital samples.

Many computer systems run multimedia application software that allows a user to view MPEG movies or listen to MPEG audio. As multimedia applications have become more sophisticated, the demands placed on computers have increased. Microprocessors are now routinely provided with enhanced support for these applications. For example, many processors now support single-instruction multiple-data (SIMD) commands such as MMX instructions. Advanced Micro Devices, Inc. (hereinafter referred to as AMD) has implemented 3DNow!™, a set of floating point SIMD instructions on x86 processors such as the Athlon™ processor. Software applications may use these instructions to accomplish signal processing functions and the traditional x86 instructions to accomplish other desired functions.

However, though the above instructions may be efficient, the repeated execution of some of the encoder compression floating point calculations may take as much as 25% of the computational overhead of an MPEG/audio compression algorithm. Therefore, a more efficient way of performing the calculations associated with the psychoacoustic model is desired.

SUMMARY OF THE INVENTION

Various embodiments of an efficient finite length POW10 calculation for MPEG audio encoding are disclosed. In one embodiment, a method for encoding an audio input signal includes storing a plurality of predetermined tonal values corresponding to a plurality of predetermined power levels. The method also includes receiving a plurality of input values each representative of a power level of a spectral component of the audio input signal at a corresponding frequency sub-band and accessing at least one corresponding tonal value of the plurality of predetermined tonal values. The method further includes generating an encoded output signal representative of the audio input signal by using at least one corresponding tonal value for each of the plurality of input values. Further, the storing of the plurality of predetermined tonal values is performed prior to the receiving of the plurality of input values.

In an additional embodiment, a method for calculating tonal values of spectral components of an audio input signal for an audio encoder includes storing a plurality of predetermined tonal values corresponding to a plurality of predetermined power levels, receiving a plurality of input values each representative of a power level of a spectral component of the audio input signal at a corresponding frequency sub-band and accessing at least one corresponding tonal value of the plurality of predetermined tonal values. The method further includes generating a composite tonal value using at least one of the corresponding tonal values. Further, storing the plurality of predetermined tonal values is performed prior to receiving the plurality of input values.

BRIEF DESCRIPTION OF THE DRAWINGS

FIG. 3A is a diagram of one embodiment of a psychoacoustic model integer look-up table.

FIG. 3B is a diagram of one embodiment of a psychoacoustic model decimal look-up table.

Figure 1:
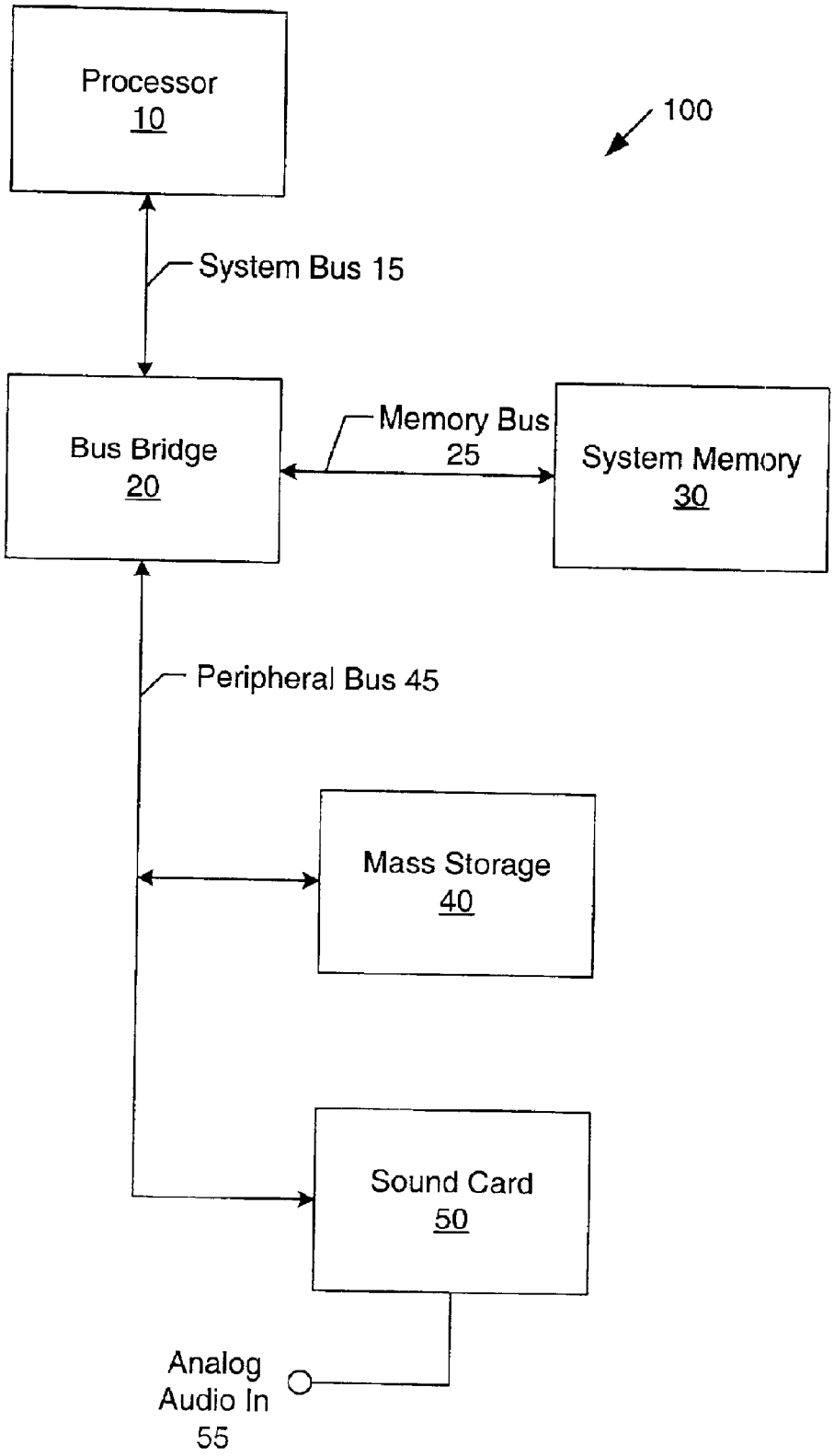
FIG. 1 is a block diagram of one embodiment of a computer system.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE PREFERRED EMBODIMENTS

Turning now to FIG. 1, a block diagram of one embodiment of a computer system is shown. Computer system 100 includes a processor 10 coupled to a bus bridge via a system bus 15. A system memory 30 is also coupled to bus bridge 20 through a memory bus 25. A mass storage 40 and a sound card 50 are also coupled to bus bridge 40 through a peripheral bus 45.

In one embodiment, system memory 30 is a memory in which application programs may be stored and from which processor 10 may primarily execute. A suitable system memory 30 comprises Dynamic Random Access Memory (DRAM). For example, a plurality of banks of SDRAM (Synchronous DRAM), DDR SDRAM (Double Data Rate), or Rambus DRAM (RDRAM may be suitable. In addition, computer system 100 may include installation media devices such as a CD-ROM (not shown) or a floppy disk (not shown).

As described above, processor 10 may execute software instructions that perform an MPEG/audio encoding process. During the encoding process, digital audio samples may be encoded or compressed into the MPEG/audio format. The digital audio sample may come from various sources. In one embodiment, the MPEG/audio encoder may be an application. However it is contemplated that the MPEG/audio encoder software may be incorporated into the operating system. It is also contemplated that in other embodiments, more than one processor such as processor 10 may run the encoding process software.

In this particular illustration, sound card 50 may accept an analog audio input 55. Sound card 50 may then convert the analog signal into a digital representation consisting of multiple digital samples which may be stored to mass storage 40. It is contemplated that mass storage 40 may be a hard disk drive, a tape drive, a ram disk or any other storage device suitable for storing digital data. In other embodiments, the digital audio samples may come from other sources such as digital audio files, referred to as WAV files. It is contemplated that other sources may also provide digital audio samples to computer system 100.

Functional blocks may represent the MPEG/audio encoder software routines. One of the blocks is the psychoacoustic model introduced in the background section above. As will be described in greater detail below, the psychoacoustic model is used to calculate a signal-to-mask ratio which is then used in subsequent calculations for allocation of bits during the encoding process.

Figure 2:
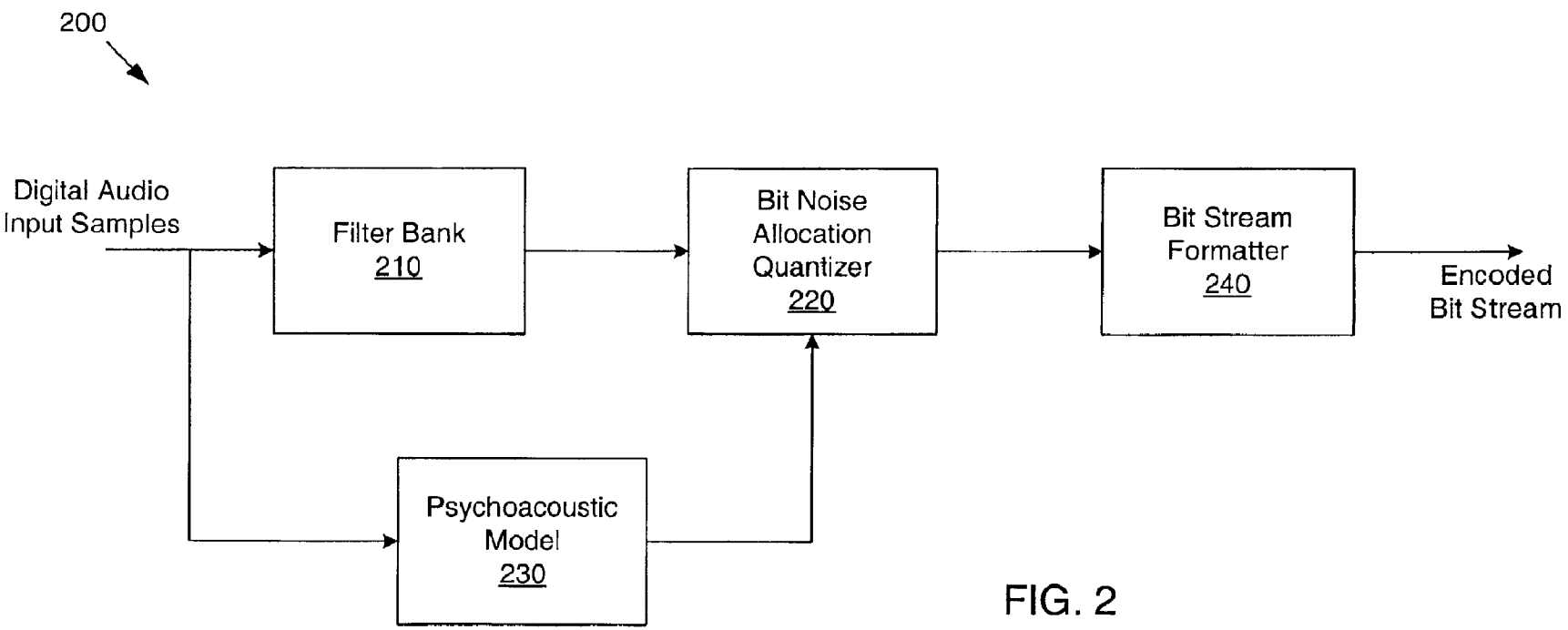
FIG. 2 is a functional block diagram of one embodiment of an audio encoder.

Referring to FIG. 2, a functional block diagram of one embodiment of an audio encoder is illustrated. Audio encoder 200 includes a filter bank 210 coupled to a bit noise allocation quantizer 220. Bit noise allocation quantizer 220 is coupled to a bit stream formatter 240. A psychoacoustic model 230 is coupled to receive digital audio input samples from the same source as filter bank 210. The output of psychoacoustic model 230 is coupled to bit noise allocation quantizer 220.

As described above in conjunction with the background, filter bank 210 may perform a time to frequency transformation of the digital audio samples. Thus transforming the samples into frequency spectra.

Psychoacoustic model 230 also transforms the digital audio samples into bands, referred to as frequency spectra. In one embodiment, psychoacoustic model 230 may use a fast Fourier transform to perform the transformation. Once transformed, each of the frequency bands is represented by a power level. The bands may then be broken into further sub-bands characterized according to the human aural range. Psychoacoustic model 230 may then calculate the signal-to-mask ratio for each frequency sub-band by determining the tonal and non-tonal components.

In one embodiment, an interim power of ten calculation is used when determining the tonal components of the frequency sub-bands. This power of ten calculation is typically a floating-point calculation. The power level associated with a particular frequency sub-band is operated on by a software instruction referred to as POW10. The POW10 calculation is closely approximated a $10^x$ floating-point calculation where x is the power level associated with a particular sub-band. In some applications, as each sub-band is input to the software routine, processor 10 of FIG. 1 may be used to execute the floating-point calculation. The results are used in subsequent signal-to-mask ratio calculations. As described in the background, these calculations may account for as much as 25 percent of the processing overhead of the encoder.

If the input power level is a floating-point number x in the mathematical expression $10^x$, then 'x' may have both an integer portion and a decimal portion. Thus the above mathematical expression $10^x$ may also be expressed as $10^{i+d}$, or $10^i \times 10^d$, where 'i' is the integer and 'd' is the decimal. Thus, if the floating-point number x is separated into its integer and decimal portions, then the $10^x$ calculation may be performed on the integer and decimal portions independently. The result of the independent integer and decimal calculations may then be multiplied together to obtain the resultant $10^x$.

In one embodiment, the POW10 calculations may be done while the encoder software is initializing. During initialization, the POW10 calculations may be performed on a finite set of possible input values representing the power levels of the frequency sub-bands. These values may be stored in system memory 30 or mass storage 40 of FIG. 1. As will be described in greater detail below, the calculations may be stored in one or more tables, which can then be accessed by an index value.

A code segment which uses the POW10 calculations is shown below as a portion of the encoder software. It is noted however that the code segment shown below is only an exemplary code segment and that in other embodiments, other code segments and other programming languages may be used.

```
Initialization:
    for(i=0; i<512;i++) int_pow[i] = pow(10.0, (float)i); //POW of positive integer number
    for(i=0; i<1024;i++) dec_pow[i] = pow(10.0, (float)i/1024.0f); //POW of positive decimal number
POW10 Calculation:
    input_data = (int)(input_float_data*1024f); // Scale up the input floating-point number by 1024
    if(input_data < 0 {                         //If input is a negative number
        input_data = -input_data;               //Change the number to a positive number
        int_part = input_data;
        int_part >>= 10;                        //Obtain the integer part of the integral part of the input data
```

-continued

```
        int_part &= 511;                //Make sure the integer part is within (0,511)
        dec_part = input_data - (int_part <<10); //Obtain the decimal part of the integral part of
the input data
        result = 1.0/int_pow[int_part];
        result /= dec_pow[dec_part]; //Result =1/( POW of negative integer number * POW of
negative decimal number)
    }
else {
        int_part = input_data;
        int_part >>= 10;                //Obtain the integer part of the integral part of the input data
        int_part &= 511;                //Make sure the integer part is within (0,511)
        dec_part = input_data - (int_part <<10); //Obtain the decimal part of the integral part of
the input data
        result = int_pow[int_part];
        result *= dec_pow[dec_part]; //Result is POW of positive integer number * POW of
positive decimal number
    }
```

As described above, the illustrated code segment uses power of ten values previously calculated using floating-point calculations and stored in memory to perform integer calculations. The resulting integer calculations may reduce processor overhead associated with psychoacoustic model 230.

Turning now to FIG. 3A, a diagram of one embodiment of a psychoacoustic model integer look-up table is shown. In one embodiment a tonal value integer table 300 includes an int_part column and an int_pow column. The int_part column holds the integer values that correspond to a finite set of possible integers that may be input to psychoacoustic model 230 of FIG. 2. In the illustrated embodiment, the table holds values for integers 0 through 511. Negative numbers are handled by the code segment shown above in conjunction with the description of FIG. 2. In FIG. 3A, the int_pow column holds an example of the tonal values that correspond to the floating-point calculations performed by the POW10 calculation shown above in the code segment on each one of the integers in the finite set of integers. It is noted that the tonal values in the int_pow column begin to get large quickly. It is shown that the values become so large that for integers larger than 39, the tonal value in the int_pow column is the same as that in row 39. Since power levels of the frequency spectra which are larger than 39 in any particular sub-band correspond to tonal values that may be large enough to not be humanly discernable, the table need not hold values higher than that. However, to simplify the code segment, an input value above 39 will still return a value. It is also noted that in other embodiments, the values in the int_pow column may be different due to differences in the POW10 calculation.

It is noted that in the illustrated embodiment the int_part column is numbered from 0 to 511, which corresponds to the finite set of possible integers. It is contemplated that in other embodiments more or less integer values may be used in the finite set and therefore tonal value integer table 300 may have more or less entries.

Referring to FIG. 3B, a diagram of one embodiment of a psychoacoustic model decimal look-up table is shown. In one embodiment, a tonal value decimal table 350 includes a dec_part column and a dec_pow column. The dec_part column holds the decimal index values that correspond to a finite set of possible decimals that may be input to psychoacoustic model 230 of FIG. 2. The dec_pow column holds the tonal values that correspond to the floating-point calculations performed by the POW10 calculation shown above in the code segment on each one of the decimals in the finite set of decimals.

It is noted that in the illustrated embodiment the dec_part column is numbered from 0 to 1023, which corresponds to the finite set of possible decimals. It is contemplated that in other embodiments more or less decimal values may be used in the finite set and therefore tonal value decimal table 350 may have more or less entries.

Referring collectively to FIG. 3A and FIG. 3B, although the integer and decimal tonal values are illustrated as tables in these embodiments, it is noted that the tables are only exemplary illustrations. It is contemplated that in other embodiments, the integer and decimal tonal value tables may be implemented in various other ways including arrays or linked lists for example.

Various embodiments may further include receiving, sending or storing instructions and/or data implemented in accordance with the above description upon a carrier medium. Generally speaking, a carrier medium may include storage media or memory media such as magnetic or optical media, e.g., disk or CD-ROM, volatile or non-volatile media such as RAM (e.g. SDRAM, DDR SDRAM, RDRAM, SRAM, etc.), ROM, etc. as well as transmission media or signals such as electrical, electromagnetic, or digital signals, conveyed via a communication medium such as network and/or a wireless link.

Numerous variations and modifications will become apparent to those skilled in the art once the above disclosure is fully appreciated. It is intended that the following claims be interpreted to embrace all such variations and modifications.

What is claimed is:

1. A method for encoding an audio input signal, said method comprising:

storing a plurality of predetermined tonal values corresponding to a plurality of predetermined power levels in a first table and a second table;

wherein each of said predetermined tonal values includes a first portion corresponding to an integer portion and a second portion corresponding to a decimal portion, wherein said first portion is stored in said first table and said second portion is stored in said second table;

receiving a plurality of input values each representative of a power level of a spectral component of said audio input signal at a corresponding frequency sub-band;

accessing at least one corresponding tonal value of said plurality of predetermined tonal values; and for each of said plurality of input values, using at least one corresponding tonal value to generate an encoded output signal representative of said audio input signal;

wherein said storing a plurality of predetermined tonal values is performed prior to said receiving said plurality of input values.

2. The method as recited in claim 1, wherein said encoded output signal is encoded by selectively including and removing particular frequency sub-bands of said audio input signal.

3. The method as recited in claim 2, wherein said selectively including and removing said particular frequency sub-bands is based on said corresponding tonal values.

4. The method as recited in claim 1, wherein said accessing at least one particular value includes determining an integer portion and a decimal portion of each of said plurality of input values and indexing into said first table using said integer portion of said plurality of input values and indexing into said second table using said decimal portion of said plurality of input values.

5. A method for calculating tonal values of spectral components of an audio input signal for an audio encoder, said method, comprising:

storing a plurality of predetermined tonal values corresponding to a plurality of predetermined power levels a first table and a second table;

wherein each of said predetermined tonal values includes a first portion corresponding to an integer portion and a second portion corresponding to a decimal portion, wherein said first portion is stored in said first table and said second portion is stored in said second table;

receiving a plurality of input values each representative of a power level of a spectral component of said audio input signal at a corresponding frequency sub-band;

accessing at least one corresponding tonal value of said plurality of predetermined tonal values; and generating a composite tonal value using said at least one corresponding tonal value;

wherein said storing a plurality of predetermined tonal values is performed prior to said receiving said plurality of input values.

6. The method as recited in claim 5, wherein said accessing corresponding tonal value includes determining an integer portion and a decimal portion of each of said plurality of input values and indexing into said first table using said integer portion of said plurality of input values and indexing into said second table using said decimal portion of said plurality of input values.

7. The method as recited in claim 6, wherein said generating a composite tonal value includes calculating a product of said first portion of said predetermined tonal values and said second portion of said predetermined tonal values.

8. A carrier medium for storing instructions executable by a processor, wherein said processor, when executing said instructions, performs a method for encoding an audio input signal, said method comprising:

storing a plurality of predetermined tonal values corresponding to a plurality of predetermined power levels a first table and a second table;

wherein each of said predetermined tonal values includes a first portion corresponding to an integer portion and a second portion corresponding to a decimal portion, wherein said first portion is stored in said first table and said second portion is stored in said second table;

receiving a plurality of input values each representative of a power level of a spectral component of said audio input signal at a corresponding frequency sub-band;

accessing at least one corresponding tonal value of said plurality of predetermined tonal values; and for each of said plurality of input values, using at least one corresponding tonal value to generate an encoded output signal representative of said audio input signal;

wherein said storing a plurality of predetermined tonal values is performed prior to said receiving said plurality of input values.

9. The carrier medium as recited in claim 8, wherein said accessing at least one particular value includes determining an integer portion and a decimal portion of each of said plurality of input values and indexing into said first table using said integer portion of said plurality of input values and indexing into said second table using said decimal portion of said plurality of input values.

10. The carrier medium as recited in claim 8, wherein said encoded output signal is encoded by selectively including and removing particular frequency sub-bands of said audio input signal.

11. The carrier medium as recited in claim 10, wherein said selectively including and removing said particular frequency sub-bands is based on said corresponding tonal values.

12. A carrier medium for storing instructions executable by a processor, wherein said processor, when executing said instructions, performs a method for calculating tonal values of spectral components of an audio input signal for an audio encoder, said method comprising:

storing a plurality of predetermined tonal values corresponding to a plurality of predetermined power levels a first table and a second table;

wherein each of said predetermined tonal values includes a first portion corresponding to an integer portion and a second portion corresponding to a decimal portion, wherein said first portion is stored in said first table and said second portion is stored in said second table;

receiving a plurality of input values each representative of a power level of a spectral component of said audio input signal at a corresponding frequency sub-band;

accessing at least one corresponding tonal value of said plurality of predetermined tonal values; and generating a composite tonal value using said at least one corresponding tonal value;

wherein said storing a plurality of predetermined tonal values is performed prior to said receiving said plurality of input values.

13. The carrier medium as recited in claim 12, wherein said accessing corresponding tonal value includes determining an integer portion and a decimal portion of each of said plurality of input values and indexing into said first table using said integer portion of said plurality of input values and indexing into said second table using said decimal portion of said plurality of input values.

14. The carrier medium as recited in claim 13, wherein said generating a composite tonal value includes calculating a product of said first portion of said predetermined tonal values and said second portion of said predetermined tonal values.

15. A computer system comprising:

one or more processors;

a memory coupled to said one or more processors;

wherein said one or more processors, during operation, is configured to:

store a plurality of predetermined tonal values corresponding to a plurality of predetermined power levels in a first table and a second table in said memory;

wherein each of said predetermined tonal values includes a first portion corresponding to an integer portion and a second portion corresponding to a decimal portion, wherein said first portion is stored in said first table and said second portion is stored in said second table;

receive a plurality of input values each representative of a power level of a spectral component of an audio input signal at a corresponding frequency sub-band;

access at least one corresponding tonal value of said plurality of predetermined tonal values and for each of said plurality of input values;

use at least one corresponding tonal value to generate an encoded output signal representative of said audio input signal;

wherein said one or more processors store said plurality of predetermined tonal values prior to said receiving said plurality of input values.

16. The computer system as recited in claim 15, wherein said encoded output signal is encoded by selectively including and removing particular frequency sub-bands of said audio input signal.

17. The computer system as recited in claim 16, wherein said selectively including and removing said particular frequency sub-bands is based on said corresponding tonal values.

18. The computer system as recited in claim 15, wherein during operation, said one or more processors access at least one particular value includes determine an integer portion and a decimal portion of each of said plurality of input values and use said integer portion of said plurality of input values to index into said first table and use said decimal portion of said plurality of input values to index into said second table.

* * * * *